US011446657B2

(12) United States Patent
Moche et al.

(10) Patent No.: US 11,446,657 B2
(45) Date of Patent: Sep. 20, 2022

(54) DEVICE FOR RECEIVING, DISPENSING, AND MOVING LIQUIDS

(71) Applicant: Microfluidic ChipShop GmbH, Jena (DE)

(72) Inventors: Christian Moche, Jena (DE); Richard Klemm, Jena (DE); Claudia Gärtner, Jena (DE)

(73) Assignee: MICROFLUIDIC CHIPSHOP GMBH, Jena (DE)

( * ) Notice: Subject to any disclaimer, the term of this patent is extended or adjusted under 35 U.S.C. 154(b) by 440 days.

(21) Appl. No.: 16/461,453

(22) PCT Filed: Nov. 16, 2017

(86) PCT No.: PCT/EP2017/079510

§ 371 (c)(1),
(2) Date: Oct. 9, 2019

(87) PCT Pub. No.: WO2018/091608

PCT Pub. Date: May 24, 2018

(65) Prior Publication Data

US 2020/0038862 A1 Feb. 6, 2020

(30) Foreign Application Priority Data

Nov. 16, 2016 (DE) ..... 10 2016 122 056.6

(51) Int. Cl.
*B01L 3/00* (2006.01)

(52) U.S. Cl.
CPC ... *B01L 3/502715* (2013.01); *B01L 3/502723* (2013.01); *B01L 3/502738* (2013.01);
(Continued)

(58) Field of Classification Search
CPC ..... B01L 3/502715; B01L 3/502723; B01L 3/502738; B01L 2200/0684;
(Continued)

(56) References Cited

U.S. PATENT DOCUMENTS

2003/0143112 A1 7/2003 Suslick et al.
2010/0129898 A1* 5/2010 Squirrell ..... B01L 7/00 435/287.2
2012/0187117 A1 7/2012 Weber

FOREIGN PATENT DOCUMENTS

CN 101300472 A 11/2008
CN 204514801 U 7/2015
(Continued)

OTHER PUBLICATIONS

German Office Action dated Feb. 17, 2022 to Microfluidic ChipShop GmbH for Application No. 10 2016 122 056.6. filed Nov. 16, 2016.

*Primary Examiner* — Christine T Mui
(74) *Attorney, Agent, or Firm* — Vorys, Sater, Seymour and Pease LLP

(57) ABSTRACT

A microfluidic system comprising a chamber closed by movable elements and connected to at least one channel. The system has at least one structured component and at least one component attached to the structured component. The chamber is used such that the movable element can be moved into the chamber as well as out of the chamber by a movement of the movable element. Liquids or gases can be moved via one or more channels connected to the chamber by the movement and dispensed or received out of the structured component via a connection of the channel. A liquid reagent reservoir is connected to the pump chamber via the sample supply channel. Thus, the system can be used to receive, pump, dilute, mix, and dispense liquids or gases.

50 Claims, 13 Drawing Sheets

(52) U.S. Cl.
CPC ... *B01L 2200/0684* (2013.01); *B01L 2200/16* (2013.01); *B01L 2300/042* (2013.01); *B01L 2300/0654* (2013.01); *B01L 2300/123* (2013.01); *B01L 2400/06* (2013.01); *B01L 2400/0638* (2013.01); *B01L 2400/0644* (2013.01)

(58) Field of Classification Search
CPC ..... B01L 2200/16; B01L 2300/042; B01L 2300/0654; B01L 2300/123; B01L 2400/06; B01L 2400/0638; B01L 2400/0644
USPC ..... 422/502, 500, 50
See application file for complete search history.

(56) References Cited

FOREIGN PATENT DOCUMENTS

| | | | |
|---|---|---|---|
| CN | 105939779 | A | 9/2016 |
| DE | 10202996 | A1 | 8/2003 |
| WO | 2007/057744 | A2 | 5/2007 |
| WO | 2008143902 | A2 | 11/2008 |
| WO | 2010/091246 | A2 | 8/2010 |
| WO | 2015/077412 | A1 | 5/2015 |
| WO | 2015/084458 | A2 | 6/2015 |

* cited by examiner

DEVICE FOR RECEIVING, DISPENSING, AND MOVING LIQUIDS

The invention relates to a device for receiving, discharging, diluting or moving of liquids and for the addition of liquid components, which can also be referred to as a fluidic system, and particularly relates to a microfluidic system. The device can also be referred to as a chip.

BACKGROUND

The intake and discharge of liquids and gases as well as their movement including mixing in fluidic systems, particularly in microfluidic systems, is often carried out via an externally connected pump, which is connected to the fluidic system via a fluidic interface, via syringe pumps integrated into the fluidic system or via membrane valves. All these solutions require an appropriate control device to operate the pumps or valves and are not suitable for easily implementing functions such as receiving, discharging and/or moving liquids in lab-on-a-chip systems.

The external pumps used to manipulate lab-on-a-chip systems require a fluidic interface, which requires additional components to be used, and which, like all fluidic interfaces, involves the risk of leakage.

Syringe pumps integrated directly into fluidic systems avoid a fluidic interface to the outside, but require another element, the plunger, in order to move liquids.

Membrane valves offer the advantage that they do not require a fluidic interface or any other components and only require a pre-formed recess and a movable cover for actuation. They are configured in such a way that they can be operated pneumatically or mechanically. Generally, these membrane valves are operated by an appropriate operating device.

The intake and discharge of liquids, the distribution to different reaction cavities, the movement of liquids as well as the addition of reaction components require manual handling steps or a corresponding automation of these steps by means of large automats. This is done manually during sample collection and reagent supply by pipetting, mixing and incubation is carried out, for example, by shaking titer plates and reagents are taken from appropriate storage containers for supply. Both manual handling and automated handling require a larger number of handling steps, additional equipment such as pipettes or pipette automats as well as storage facilities for the corresponding reagents.

In microfluidic systems, handling is usually carried out via external pumps and a device is required to control the system.

This invention combines all handling steps including reagent storage on a manually operated component.

SUMMARY OF THE DISCLOSURE

The object of the invention is to be able to take in, dispense, dilute, transport and/or mix liquids manually, i.e. without any further aids, as well as with corresponding devices. This should preferably be possible in fluidic systems without an external pump or suction device, preferably also manually. A particular feature of the system is that multiple intakes and discharges of liquids are possible and that desired volumes of the received or discharged liquid can be precisely controlled.

The object is solved by the features of independent claims. Advantageous embodiments are indicated in the dependent claims.

A fluidic system is provided, comprising a structured component with a chamber and a channel system, which are sealed fluid-tight with a component, wherein the chamber is fluidically connected to the outside via the channel system and a fluidic interface. The component has a flexible or movable portion that can be moved into the chamber portion or beyond a plane of the chamber. The plane of the chamber is the upper boundary of the chamber on the side to the chamber, i.e. the bottom side of the component closing the chamber. By moving the flexible portion, liquids or gases can be taken in or discharged through the fluidic interface or moved in the fluidic system. The moving portion can be moved manually or with an appropriate operating device. One option is to push or move the flexible portion up into different positions. Particularly advantageous are the possibility of a defined liquid discharge and intake through the combination of the chamber with a small channel system, the multiple intakes and discharges of liquids as well as the possibility of manual operation.

The fluidic system preferably has an interface for a liquid reagent reservoir.

Particularly advantageous is the configuration of the component which closes the structured component as a foil, wherein the foil is also the moving component due to its intrinsic flexibility.

The dilution of the received liquid or the supply of reagents takes place via the emptying of a liquid reservoir connected to the structured component, which can be configured as a blister. The external geometry of the fluidic interfaces can influence the liquid intake and liquid discharge.

The volume can be defined by the corresponding outlet geometry of the fluidic interface, wherein this volume definition can be further influenced by a surface modification of the fluidic interface.

Another fluidic system is also provided, comprising a structured component with a chamber and a channel system which are hermetically sealed with a further component, the chamber being fluidically connected to the outside via the channel system and a fluidic interface. The flexible portion is formed by the walls of the chamber.

A particular advantage here is that a lateral pressing of the chamber also enables the movement of the liquid or the compression effect can be increased by the flexible chamber walls.

In addition, a further fluidic system is provided, comprising a structured component or a structured module as well as a further component which seals the chamber and the channel system hermetically and connects the chamber to the outside via the channel system and the fluidic interface. The structured component is configured in such a way that the chamber bottom is flexible and can be pushed in or expanded.

A particular advantage of this embodiment is that the bottom can be configured to be particularly flexible and can be manufactured by means of two-component injection moulding, so that a flexible component can be injection-moulded together with another component. Alternatively, the base material of the structured component can also be sufficiently flexible to guarantee the functionality of the component. An assembly of the flexible portion into the structured component is also possible.

The chamber can be connected to a fluidic interface via another channel system, wherein one of the fluidic interfaces can be closed with a cap. The closure with a cap also prevents liquid from escaping at this point.

Preferably, the integration of valves, for example capillary stopping valves, which act by changing the capillary diameter, allows the intake of defined volumes.

Preferably, a valve function is created by local modification of the surface, or the function of existing geometrically acting valves is enhanced a by surface modification in the valve area.

A particular advantage of this embodiment is that venting can take place when liquid is taken in through the second fluidic interface and that liquid can also be taken in and discharged at various points. The closure with the cap also prevents liquid from escaping at this point. Furthermore, it is advantageous to position the fluidic system in such a way that the discharging fluidic interface is inclined downwards when the liquid is discharged.

Preferably, the fluidic system includes a venting option for the chamber, which can be provided via an additional channel communicating with the outside or a gas-permeable membrane, and this venting device can be optionally closed.

Preferably, the fluidic system includes an inlet channel, which has a passive stopping function, for example a capillary stopping valve, a channel tapering or a corresponding surface modification, and receives a defined quantity of liquid either by a capillary effect, which can be intensified by surface modifications in the portion to be filled, or by a change in the chamber volume caused by the moving components.

The intake of very precise volumes without the use of expensive pipetting units is particularly advantageous here.

In a preferred configuration, the fluidic system includes an additional reagent reservoir. This can be formed as a blister, for example.

The particular advantage here is that several liquids or dry reagents can be mixed together and the reagent can be used to transport the received liquid or liquid in the system.

Preferably, dry reagents are provided in the structured component, which can be taken up by the flowing liquids and mixed with them.

Preferably, a reagent is provided at a defined position, which colors the liquid flowing over it and thus indicates that the position at which the reagent is present has been reached, and thus that a certain volume or dwell time has been reached.

Preferably, a magnification function is provided in the structured component at a defined position, for example in the form of a lens integrated into the structured component, in order to be able to better follow the reaching of certain positions in the channel system by the liquid and also to be able to better read color reactions as indicator reactions.

Longer channel elements are also preferred as flow limiters in the fluid flow to enable a controlled liquid intake and liquid discharge.

In a preferred embodiment, the reagent reservoir is formed as a blister. Preferably, the reagent reservoir has a blister seat with piercing elements that pierce the fluid-tightly connected blister located above them. This embodiment has a flap which allows a defined insertion of the flap via guide elements in the blister seat and thus a defined volume dosage. The volume dosing can also be carried out in several steps due to the particular configuration of the guide elements.

The fluid-tight closure of the fluidic interface for the liquid intake, for example via a cap, makes sense. The cap can also be equipped with a transport element, for example a mandrel or plunger, which projects into the channel and thus moves the liquid in it when the cap is placed on the fluidic interface. In addition, or alternatively, the cap can also have a flexible portion that can be pushed in or pulled out after it has been placed to move the liquid in the channel or channel system. When pushing, the liquid is pushed further into the channel. As the flexible portion is pulled out, liquid is moved out of the channel towards the fluidic interface. This allows small movements to be generated.

The particular advantage here is that defined liquid volumes can be discharged from the blister and this can also be done manually with high precision. In combination with a defined volume intake, an exact mixing ratio can thus be set.

In a preferred embodiment, the fluidic system has a long channel to the chamber. This long channel is particularly advantageous, as it can be used to adjust the speed of the liquid intake and to introduce reagents into the channel, which are optimally resuspended due to the long length of the channel.

In a preferred embodiment, the long channel to the chamber has additional widenings. This embodiment is particularly advantageous, as reagents can be pre-assembled in the widenings and improved mixing can be achieved through a different flow profile.

In a preferred embodiment, the fluidic system includes a cavity or detection chamber for optical readout and/or reaction which can preferably have different depths. A particular advantage here is that optical detection can be performed directly and, if the detection chamber is configured with several depths, the dynamic range can also be increased.

In a preferred embodiment, the fluidic system includes a lateral flow strip, which allows filling by the operation of the chamber. One embodiment includes a venting membrane, another one a venting channel. Particularly advantageous is the possibility of liquid intake, which can be operated manually, with the direct possibility of a read out via the lateral flow strip. Particular aeration options allow the combination of the negative pressure driven flow achieved by the chamber with the subsequent liquid movement by the suction effect of the lateral flow strip.

In a preferred embodiment, the fluidic system includes more than one chamber, which are connected to one another by a channel system and can be arranged in one or more planes. Particularly advantageous is that the flexible elements enable forwarding and reciprocating as well as active mixing by changing the chamber volumes.

In a preferred embodiment, the fluidic system includes attachments on the flexible components that are either located outside the chamber or extend into the chamber. A particularly advantage here is an exact definition of the volume to be taken in or discharged, which is thus independent of the force or finger size of the user even in manual operation.

In a preferred configuration, the fluidic system has reagents in the chamber. A particular advantage here is that the chamber is not only used for liquid movement, but the chamber volume can also be used directly for dissolving, reacting and mixing reagents. Dry reagents, in particular, enable the chamber to be used in a particularly advantageous way.

In a preferred embodiment, the cap for emptying the blister is directly connected to pushing elements for moving the flexible portion, if necessary, implemented integrally.

In a preferred embodiment, mixing is possible by means of moveable elements provided in the chamber, such as balls or rods, which can also be magnetic. Mixing can be additionally enhanced by structural elements in the structured component. A particular advantage here is that the simple configuration of the system allows particularly effective mixing in the chamber.

In a preferred embodiment, mixing takes place in the chamber by manually moving the fluidic system. A particular advantage here is that the simple configuration of the system allows manual use.

In a preferred embodiment, mixing takes place in the chamber by means of a mixing mechanism on the device side. A particular advantage here is that efficient mixing can take place.

In a preferred embodiment, the channel systems themselves include alignment marks, or alignment marks are attached next to, below or above the channel system, to allow volume indication. This marking is particularly advantageous similar to a ruler as it allows the user to read the received or discharged volume and to end or continue the intake or discharge of volumes in order to receive, discharge or move defined volumes.

In a preferred embodiment, multiple liquid intakes or liquid discharges are possible. A particular advantage here is that the fluidic system can be used for the multiple intakes and discharges of liquids.

In a preferred embodiment, fluidic interfaces are provided at the structured components which point in different directions, for example perpendicular to the plane of the fluidic system or leaving the fluidic system at a particular angle. A particular advantage here is that a particular geometry allows liquids to be taken in or discharged in particularly shaped surfaces or vessels.

Several fluidic interfaces are provided in a preferred embodiment.

This is particularly advantageous, as liquids can then be discharged and received at different positions simultaneously or consecutively.

In combination with a distribution system, the intake and discharge can take place at several positions simultaneously or sequentially. If a mere distribution system is used, liquids can be discharged or taken in simultaneously via the movement of the flexible elements.

In a preferred embodiment, the intake or discharge of liquids is controlled via membrane valves. This is particularly advantageous, as it allows an individual liquid intake or liquid discharge at different fluidic interfaces to take place through the movement of the flexible elements in the chamber.

A particular embodiment is the integration of passive valves into the individual distribution channels in order to ensure uniform filling and thus uniform liquid transport and thus, for example, the discharge of the same volumes.

In a preferred embodiment, the intake or discharge of liquids is controlled via rotary valves. The rotary valves preferably have a rotary valve seat (28*a*) and a rotating rotary valve body (28*b*) with a connecting channel connecting the various parts of the channel system. This is particularly advantageous as it allows individual liquid intake and liquid discharge at different fluidic interfaces to take place through the movement of the flexible elements in the chamber.

In a preferred embodiment, the fluidic system is configured as a microfluidic system. The structured component is preferably and essentially made of plastic.

In the case of the flexible element, the entire component can, for example, be made of plastic foil. It is also possible to use a flexible plastic such silicone or TPE incorporated in the other components or a movable mechanical element made of any material.

The fluidic system is also known as a thumb pump, as the flexible component is particularly easy to operate with the thumb.

DETAILED DESCRIPTION

The present invention describes a fluidic system including a chamber which has a flexible or movable part, usually the bottom or lid, in particular embodiments also movable walls, which, by lifting or lowering, allows the intake, discharge, displacement, dilution or mixing of liquids or gases which are connected to the chamber via at least one channel or opening.

The chamber and the movable part are configured such that, by a movement of the movable part from its initial position, a predetermined and adjustable volume of the chamber is displaced. In this way, predetermined volumes can be received or discharged in the chamber when the moving part is returned to another position or to the initial position. In other words, the volume is predetermined by the properties of the fluidic system or can be adjusted by the configuration of the fluidic system according to the invention.

Figure 1A:
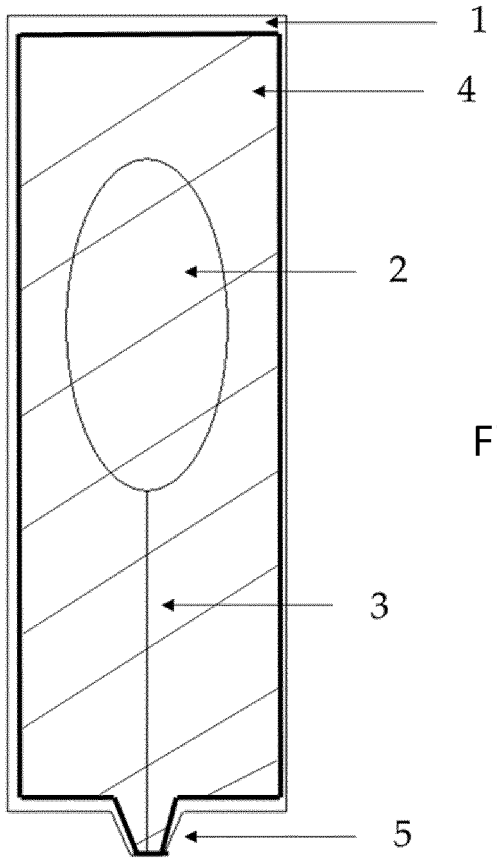
FIG. 1*a* to 1*c* show a fluidic system according to an embodiment.
Figure 1B:
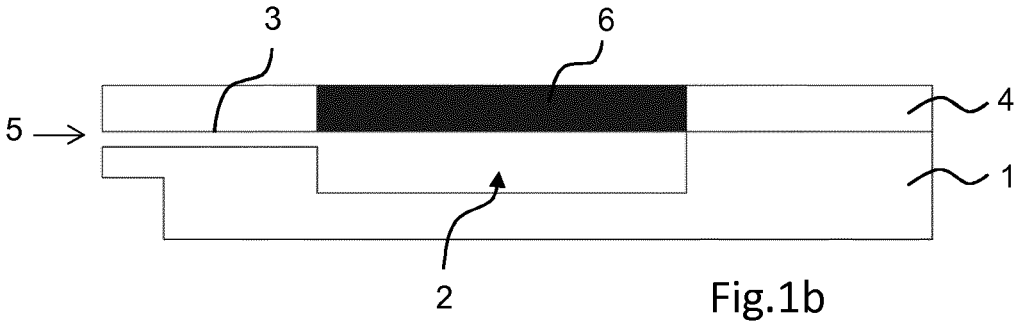
Figure 1C:
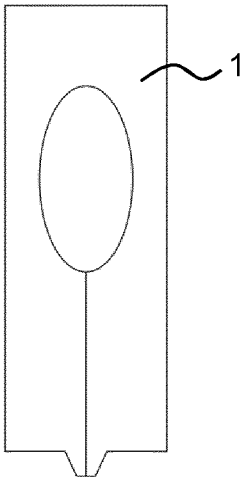

FIGS. 1*a* to 1*c* show an embodiment of the fluidic system. FIG. 1*a* and FIG. 1*c* show a top view of the fluidic system, and FIG. 1*b* shows a cross-sectional view of the fluidic system.

The fluidic system has a structured component 1 including a chamber 2, wherein the chamber 2 is connected to a channel system 3. The structured component 1 is essentially flat or plate-like. In other words, the structured component 1 has a first main side and a second main side which are parallel to each other. The chamber 2 and the channel system 3 are formed on the first main side on the surface of the structured component 1. In other words, the chamber 2 and the channel system 3 are embedded at the main side into the surface of the structured component 1. The chamber 2 and the channel system 3 thus are a recess on the surface of the structured component 1. For example, the first main side is an upper side of the structured component 1, and the second main side is a bottom side of the structured component 1. Side surfaces of the structured component 1 are arranged between the upper side and the bottom side of the structured component 1. The structured component 1 can, for example, be rectangular in shape. The structured component 1 can also be disc shaped. However, the structured component 1 can take on any shape as long as it is essentially flat.

The structured component 1, for example, can be configured as a platform. The structured component 1 can also be referred to as a structured module 1. The structured component 1 can be flat.

The chamber 2 or the channel system 3 thus has an upper side which corresponds to the upper side of the structured component 1. A bottom side of the chamber 2 or the channel system 3 is formed inside the structured component 1. The bottom side of the chamber 2 can also be referred to as a chamber bottom 7. The interior of the chamber 2 is formed between the upper side of the chamber 2 and the bottom side.

The chamber 2 or the channel system 3 can be configured as a recess in the structured component 1, for example on the upper side or the bottom side of the structured component 1. The chamber 2 and the channel system 3 can be configured as recesses of different depths.

The chamber 2 and the channel system 3 are fluidically connected to the outside via a fluidic interface 5. In other words, the fluidic interface 5 is an opening of the channel system on a side surface of the structured component 1. The opening of the fluidic interface 5 can also be arranged on an upper side or lower side of the fluidic system. As can be seen in FIG. 1*a*, the structured interface 5 can protrude as a projection from one side surface of the structured component 1. In this case it is possible with the fluidic system to take in liquid directly from a liquid surface, for example liquid located in a container open at the top, by immersing the projection in the liquid and moving the flexible or movable part.

The fluidic system may have a plurality of fluidic interfaces 5, each of which is connected to the channel system 3. The fluidic interfaces 5 can be arranged at different surfaces of the structured component 1, for example the top side, bottom side or side surfaces. In other words, the openings of the fluidic interfaces 5 may point in different directions, i.e. they may have different orientations with respect to the centre of the structured component 1.

A second component 4 seals the channel system 3 and the chamber 2 liquid- and gas-tight, so that the supply and discharge of liquids and gases can only take place via the fluidic interface 5. In other words, the second component 4 is arranged at the surface of the structured component 1 in such a way that it closes the chamber 2 and the channel system 3 on the upper side of the structured component 1. The second component 4 can, for example, be glued to the structured component 1 or welded to the structured component 1.

In other words, at the top side of the chamber 2, the interior of the chamber 2 is bounded by the bottom side of the second component 4. The chamber 2 may have an essentially flat oval, rectangular or round shape. The chamber 2 or the interior of the chamber 2 is thus defined on the one hand by the structured component 1 and on the other hand by the second component 4.

The second component 4 is flexible or the second component 4 has a flexible or movable portion 6. As shown in FIG. 1*b*, the flexible portion 6 of the second component 4 is located above the chamber 2 as a direct part of the second component 4. Alternatively, the flexible or movable portion 6 can be configured as an additional part of the fluidic system. The flexible or movable portion 6 of the second component 4 should be arranged at least at one portion of the chamber 2 or the outside of the chamber 2.

The second component 4 can be for example a foil or strip and can be made of plastic or metal.

Figure 2:
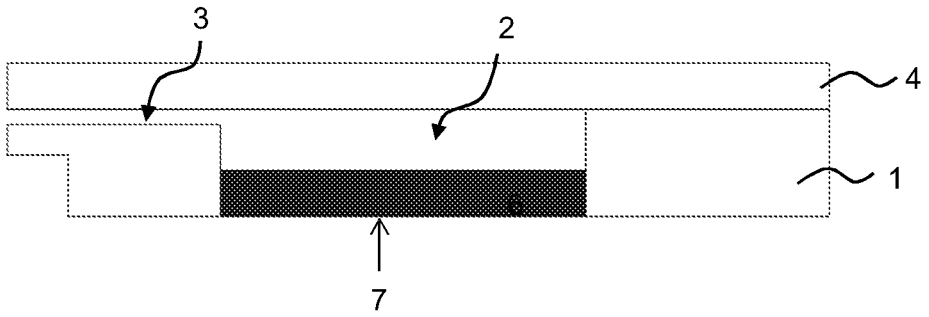
FIG. 2 shows a fluidic system according to an alternative embodiment.
Figure 3:
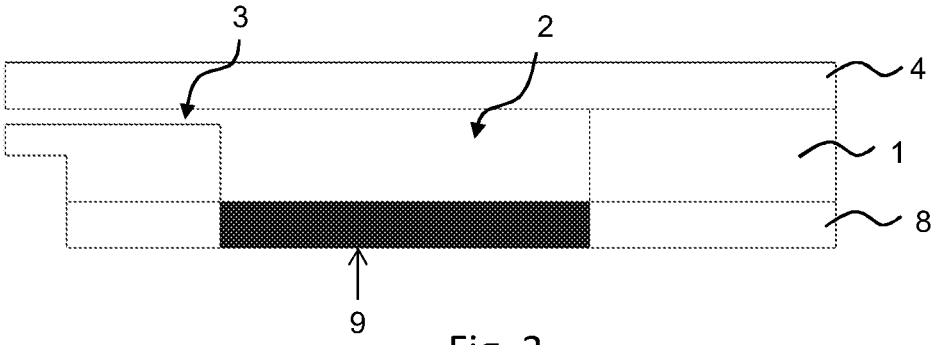
FIG. 3 shows a fluidic system according to another alternative embodiment.

Alternative embodiments of the fluidic system are shown in FIG. 2 and FIG. 3. In accordance with the alternative embodiment shown in FIG. 2, the structured component 1 has a flexible portion 7 below the chamber 2. In other words, the flexible portion 7 is located between the chamber bottom and the bottom side of the structured component 1. The flexible portion 7 can either be realized by attaching another component to the structured component 1 or directly by the material property of the structured component 1 itself or by manufacturing from more than one material, for example by multi-component injection molding.

Another alternative embodiment is shown in FIG. 3. According to the further alternative embodiment, the structured component 1 is closed with the second component 4 and furthermore with a further component 8, wherein one or both of the components 4 and 8 can have a flexible or movable portion. In other words, the second component 4 is arranged on the upper side of the structured component 1. This means that the upper side of the chamber 2 is closed with the second component 4. On the bottom side of the structured component 1 the further component 8 is arranged. This means that the bottom side of the chamber 2, i.e. the chamber bottom, is closed with the further component 8. As shown in FIG. 3, a flexible portion 9 is provided in the further component 8.

The structured component 1 is preferably configured with a cover foil, which has sufficient flexibility for pushing in and lifting above or below the chamber 2.

Preferably, the chamber 2 is configured in such a way that the flexible portion(s) 6, 7, 9 do not fill the entire chamber 2 when pushing into the chamber 2. In other words, if the flexible portion 6, 7, 9 is pressed into the chamber 2, the flexible portion will not be flush with the chamber bottom. This means that liquid or gas in the chamber 2 is not completely discharged from the chamber 2 by pushing in the flexible portion 6, 7, 9. Furthermore, a tight sealing of the flexible portions 6, 7, 9 with the chamber bottom or the adjacent channel systems 3 is not necessary for the functionality.

An exemplary operation of the embodiment shown in FIGS. 1A to 1C is described below:

Liquid intake: In order to take liquids/gases into the fluidic system, or more precisely into the chamber 2 of the fluidic system, the flexible portion 6 is pushed downwards from the initial position manually or by hand, for example with a finger of a user, or by means of an operating device. In other words, the flexible portion 6 is moved from its initial position into the chamber 2 by pressure. This means that the flexible portion 6 is pushed from the top side into the interior of the chamber 2. By pushing the flexible portion 6 into the chamber 2, the interior space of the chamber 2 is reduced. Subsequently, the fluidic interface 5 is immersed in a liquid. The flexible portion 6 moves either automatically, due to the material properties of the flexible portion 6, partially or completely back to the initial position, or is moved back to the initial position by a movement of the operating device, for example suction or lifting off. In other words, the interior of the chamber 2 is enlarged again by moving the flexible portion 6 back to its initial position. By increasing the volume of the interior space, a negative pressure is created in the chamber 2 or in the adjacent channel system 3, which is connected to the liquid via the fluidic interface. This means that liquid is drawn into the fluidic system by the under pressure. In other words, a part of the liquid is first drawn into the channel system 3 by the negative pressure and then, if the negative pressure is sufficiently high, also into the chamber 2. Liquid is thus taken into the fluidic system. By adjusting the volume of the interior of the chamber 2 displaced by pressing down the flexible portion 6 and/or by returning the flexible portion 6 to its initial position in a defined manner, the volume of the received liquid or the positioning of the liquid in the channel system 3 or in the chamber 2 of the fluidic system can be adjusted.

Mixing liquids: The received liquid is mixed by first drawing liquid into the chamber 2, that means liquid is first taken into the fluidic system. Then either the flexible component 6 is moved or the fluidic system itself is moved. The fluidic system is moved, for example, by tilting the fluidic system several times. A fast shaking should be avoided to avoid the generation of air bubbles in the received liquid.

Discharge of liquids: Liquids are discharged from the fluidic system by pushing the flexible component 6 or the flexible components into the chamber 2. In other words, the volume of the interior of the chamber 2, which is bounded by the flexible component, is reduced by pushing the flexible component. The liquid, which is either in the chamber 2 or in the channel system 3, is discharged from the fluidic system according to the volume displaced by the movement of the flexible portion 6, i.e. by pressing the flexible portion 6 into the chamber 2. This means that the displaced liquid is discharged from the chamber 2 via the channel system 3 through the fluidic interface 5. The volume of the liquid discharged may correspond to the volume of the interior of the chamber 2 by which the chamber 2 is shrunk by pushing in the flexible portion. In this case, liquid volumes can be discharged several times. Multiple discharging can be achieved by pushing the flexible portion 6, 7, 9 step by step further into the chamber 2 or the interior of the chamber 2. Multiple discharging can also be achieved by first pressing the flexible portion 6, 7, 9 into the chamber 2 once and then moving the flexible portion 6, 7, 9 out of the chamber 2 by itself or by moving it out of the chamber 2 with the aid of an operating device as described above. The outward movement is accompanied by a backflow of at least part of the liquid in the channel system 3 connected to the chamber 2. The outward movement is followed by a repeated push of the flexible portion 6, 7, 9 into the chamber 2 for another liquid discharge. In other words, by repeatedly and alternately pushing into the chamber 2 and moving out of the chamber 2 of the flexible portion 6, 7, 9, a pumping movement or pumping functionality is performed. This leads to a repeated and alternating liquid intake and liquid discharge.

Closure of the fluidic interface 5 for sampling: A cap 14 closes the fluidic interface 5 for sampling. The configuration of this cap 14 also allows the volume in the channel system 3 to be displaced by integrated projections.

Preferably, one fluidic interface 5 is configured as an inlet 5.1 of the fluidic system, and another fluidic interface 5 is configured as an outlet 5.2 of the fluidic system. The inlet 5.1. and the outlet 5.2 are preferably formed at the structured components 1. The two fluidic interfaces 5.1 and 5.2 are formed on one side, preferably at an end face or narrow side of the chip (fluidic system). This means that the inlet and the outlet are arranged on one side of the system. This makes it possible to close the inlet and outlet with a cap 14, also known as a jumper.

The cap 14 is preferably attached to the fluidic system, preferably to the structured component 1. One or more caps 14 may be attached.

In a preferred configuration, only one cap 14 is provided, which can be attached to either the inlet 5.1 or the outlet 5.2. This can then be used to selectively take in liquid at the inlet or discharge liquid at the outlet.

The one or more caps 14 are attached to the chip by a flap 44.

Addition of liquid: The complete or partial emptying of a liquid reservoir 16 transports the collected sample through a liquid and allows dilution or addition of reagents.

The flexible portion 6 can thus be pushed below a plane defined by the top side of the structured component 1 into the chamber 2, or more precisely into the interior of the chamber 2, by external pressure due to its flexibility. On the other hand, the flexible portion 6 can be pulled out of the interior of the chamber 2 again by pulling from the outside, for example by means of a negative pressure or an attached device. This means that it can be moved beyond the plane defined by the top side of the structured component 1.

From these basic functionalities, i.e. the intake of liquid into the fluidic system, the discharge of liquid from the fluidic system and the mixing of liquid in the fluidic system, the following characteristics result for the fluidic system:

The intake, dilution, discharge, dosing or transport of liquids is possible. Liquid that has been taken into the fluidic system can be transported and stored using the fluidic system. A multiple intake and multiple discharge of liquids is possible. Mixing of liquids is possible.

The fluidic system can be used as a pipette with functions of liquid intake, liquid discharge and multiple intake and discharge of liquids, due to the configuration of the fluidic system according to the above-described embodiments and by the configuration of the chamber 2 and the flexible portion 6, 7, 9. The pipette can be operated completely manually without any further aids or by means of an operating device.

Figure 4A:
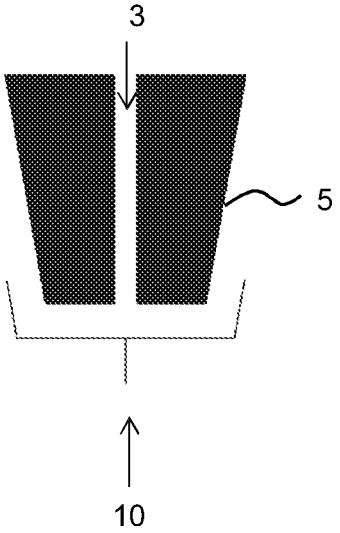
FIGS. 4*a* to 4*c* show fluidic interfaces of a fluidic system according to embodiments.
Figure 4B:
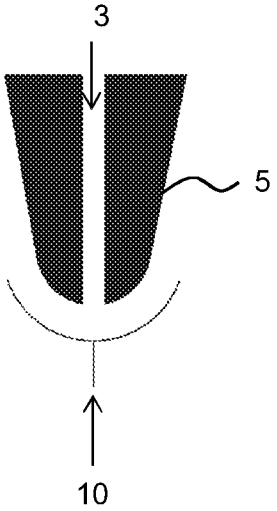
Figure 4C:
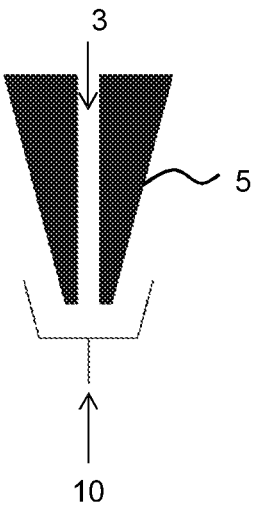

FIGS. 4*a* to 4*c* show embodiments of the fluidic interface 5. The embodiments of the fluidic interface 5 according to FIGS. 4*a* to 4*c* differ in their geometry. More precisely, the embodiments of the fluidic interface 5 each have an outlet 10, wherein the shape of the outlet 10 differs in the embodiments shown here. By the particular or defined geometry of the outlet and/or by a surface modification or a material characteristic of the outlet 10 of the fluidic interface it can be adjusted, at which volume of a drop of the discharged liquid the drop separates from the outlet. By the defined geometry of the outlet 10 of the fluidic interface 5, volumes, i.e. desired volumes, of the liquid drop of the discharged liquid can be preset. This means that the geometry of the outlet 10 of the fluidic interface 5 is also decisive for the volume of the discharged liquid. In other words, when liquid is to be discharged from the fluidic system, the flexible portion 6, 7, 9 is pushed into chamber 2 so that a drop of liquid forms at the outlet 10 of the fluidic interface 5. The flexible portion 6, 7, 9 is pushed further into the chamber 2 until the drop of liquid separates from outlet 10. Then the pushing-in of the flexible portion 6, 7, 9 or the discharging of liquid can be stopped. Alternatively, the flexible portion 6, 7, 9 can be pushed further into the chamber 2 to create another drop of liquid.

Figure 5A:
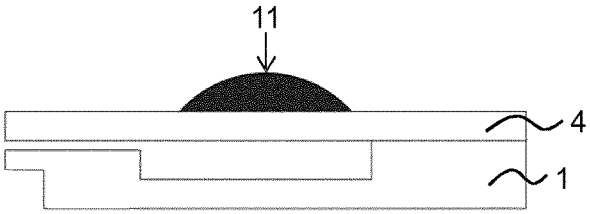
FIGS. 5*a* to 5*f* show pushing elements of a fluidic system according to embodiments.
Figure 5B:
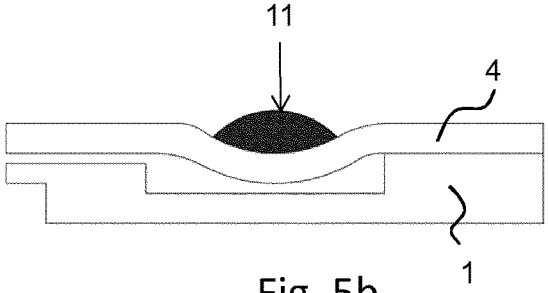
Figure 5C:
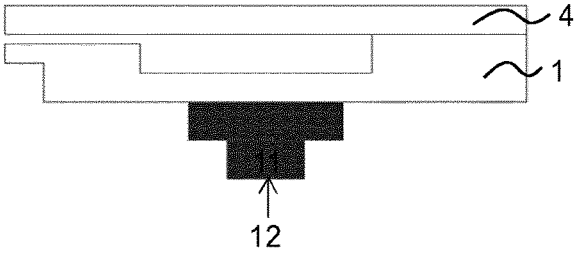
Figure 5D:
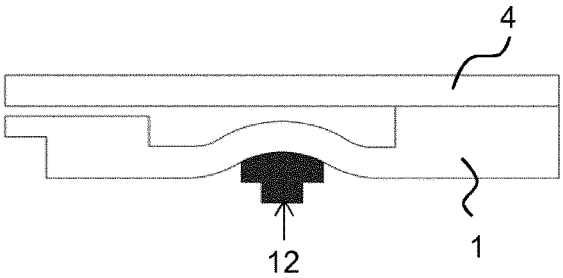
Figure 5E:
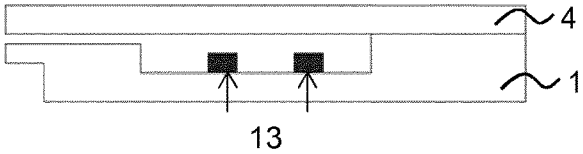
Figure 5F:
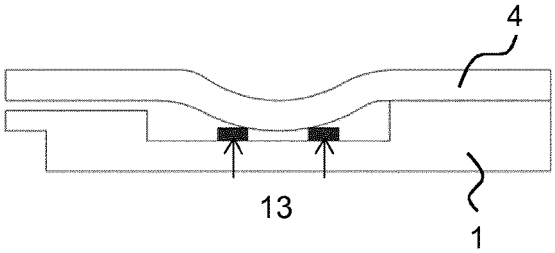

FIGS. 5*f* to 5*f* show pushing elements of the flexible portions according to different embodiments. The flexible portions 6, 7, 9 can have pushing elements 11, 12, 13 in order to allow a defined pushing of the flexible portions 6, 7, 9 into the chamber 2 or a defined pulling out or moving out of the flexible portions 6, 7, 9 from the chamber 2. In other words, in order to prevent differences due to a person-dependent application of force or finger size when operated manually or by hand, pushing elements 11, 12, 13 can be arranged or applied on the flexible portions 6, 7, 9. In other words, the pushing elements 11, 12, 13 can be used to ensure that by pressing the pushing portion 6, 7, 9 into the chamber 2 the same volume of the interior of the chamber 2 is always displaced. The pushing elements 11, 12, 13 can be operated either manually or by hand, for example with a finger, or by an operating device. The pushing elements 11, 12, 13 can be materials applied to the flexible portion 6. For example, the pushing elements 11 can be configured as a silicone hemisphere, as shown in FIGS. 5*a* and 5*b*. Alternatively, the pushing elements 12 can be manufactured directly with a flexible portion 8, for example by multi-component injection moulding, as shown in FIGS. 5*b* and 5*c*. Alternatively, a defined pushing can also be achieved using pushing elements 13, which are provided as protruding elements in the structured component, as shown in FIGS. 5*e* and 5*f*. In other words, the pushing elements 13 shown in FIGS. 5*e* and 5*f* are arranged in the chamber 2 of the fluidic system, for example on the chamber bottom, and protrude into the interior of the chamber 2. By means of the pushing elements 13, the movement of the flexible portion 6 can be limited when pushing into the chamber 2, so that only a maximum volume of the interior is displaced. FIGS. 5*a*, 5*b*, and 5*e* each show the initial state of the flexible portion 6, 7, 9, i.e. the state when no force or pressure is applied to the flexible portion 6, 7, 9. FIGS. 5*b*, 5*d* and 5*f* each show a position prior to a liquid intake or during liquid discharge, i.e. a position of the flexible portion 6, 7, 9 when it is pushed into the chamber 2.

Figure 6A:
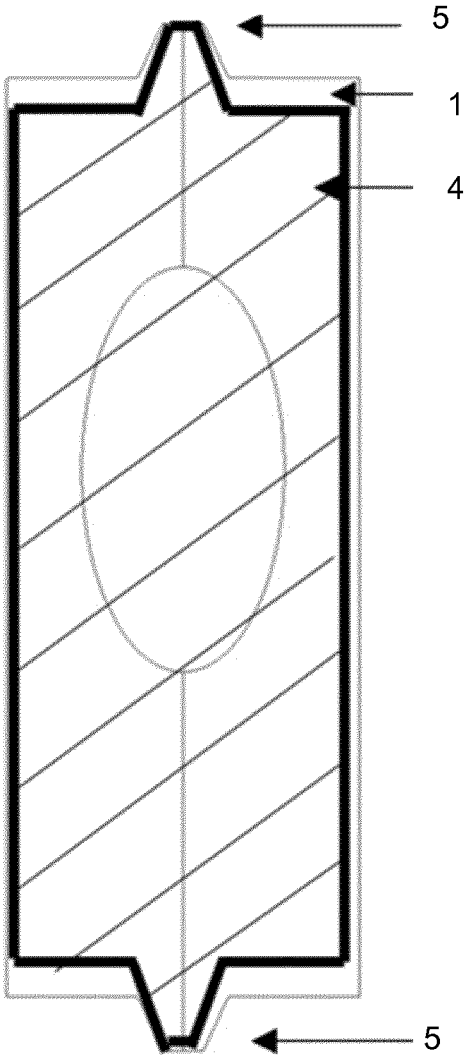
FIGS. 6*a* and 6*b* show a fluidic system according to another embodiment.
Figure 6B:
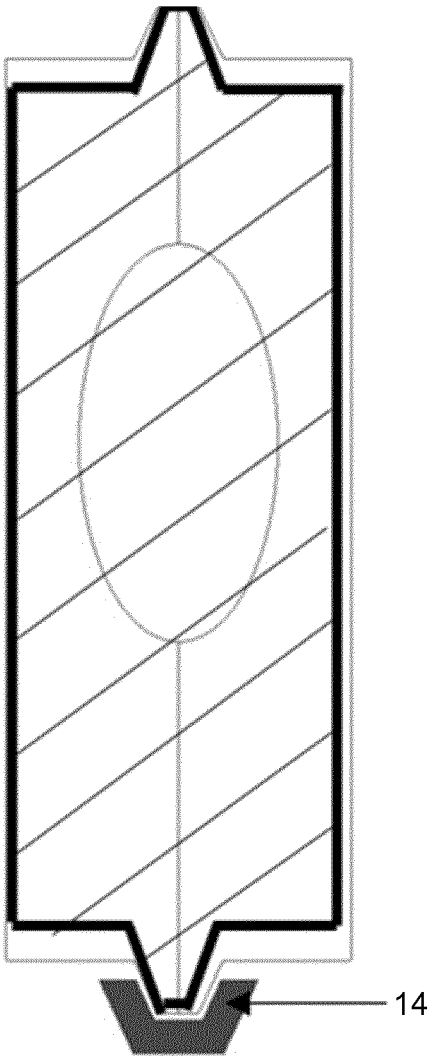

FIGS. 6*a* and 6*b* show further embodiments of the fluidic system. More precisely, FIGS. 6*a* and 6*b* show a fluidic system with two separate fluidic interfaces 5. As shown in FIGS. 6*a* and 6*b*, the fluidic interfaces 5 are arranged on different, more precisely opposite side surfaces of the structured component 1 and protrude from the respective side surfaces. Here the liquid intake can be performed by one of the two fluidic interfaces 5, and the liquid can be discharged by the other of the two fluidic interfaces 5. As shown in FIG. 6*b*, the fluidic interfaces 5 can also be closed by a cap 14 to prevent contamination or leakage of liquid from the fluidic interface 5. The cap 14 allows the liquid received in the fluidic system to be transported and stored particularly safely and easily. In other words, the cap 14 can be placed on the fluidic interface 5, or more precisely on the opening formed by the fluidic interface 5 in a side surface of the structured component 1, and seal the fluidic interface 5 fluid-tight.

Figure 7A:
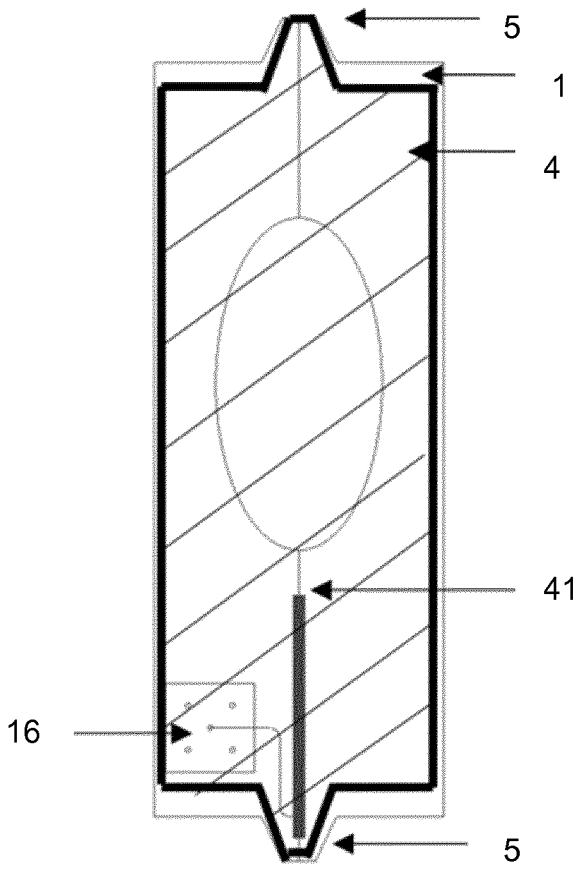
FIGS. 7*a* and 7*b* show a fluidic system according to yet another embodiment.
Figure 7B:
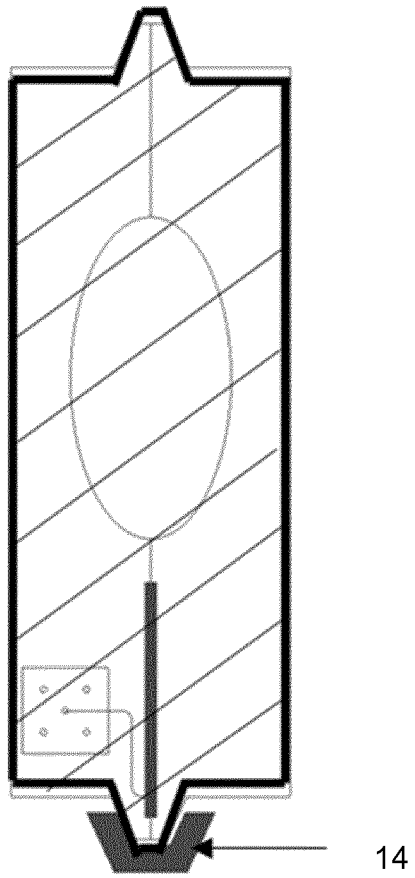

As shown in FIGS. 7*a* and 7*b*, the fluidic system can be supplemented by a liquid reservoir 16. The liquid reservoir 16 is connected to the channel system 3 or the chamber 2 via a channel. The channel can be part of the channel system 3. The liquid reservoirs 16 can, for example, be formed by one or more so-called blisters, i.e. compartments filled with liquid, for example openable by piercing, which are mounted fluid-tight on the liquid system. Liquid intake from the blister is achieved by pushing down the flexible portion 6 as described above and moving the flexible portion 6 out of the chamber 2, wherein the resulting negative pressure in the chamber 2 and the channel system 3 causes an intake of liquid from the blister into the channel system 3 or the chamber 2 via the connected channel. A leakage of liquid from the fluidic interface 5 is prevented by placing a cap 14 on the fluidic interface, when further liquid due to the emptying of the liquid reservoir 16 urges the liquid in the channel system 3 into the chamber 2 and the liquid from the liquid reservoir 16 also flows into the chamber 2. In other words, liquid taken into the fluidic system from the outside and located in the channel system 3 or the chamber 2 can be mixed with the liquid in the liquid reservoir 16. Mixing can be facilitated or intensified by placing cap 14 on the fluidic interface, since with cap 14 on, the negative pressure created by moving the flexible portion 6 acts on the liquid in the liquid reservoir 16.

The liquid reservoir 16 can also be referred to as a reagent reservoir or liquid reagent reservoir, and can contain any type of liquid.

The liquids can be mixed by moving the fluidic system, moving the flexible portion 6, 7, 9, or by inserting mixing elements. The mixing elements, for example balls made of silicone, can be moved by manual movement of the fluidic system. Alternatively, or additionally, the mixing can be carried out by means of elements made of magnetic materials, which are moved from the outside by a device for mixing.

FIGS. 7*a* and 7*b* show an embodiment of the fluidic system which combines two types of liquid intake. On the one hand, for example, the sample intake is carried out via the fluidic interface 5, which serves as the liquid inlet, by moving the flexible portion 6, 7, 8 of the chamber 2 into the chamber 2 and moving out the flexible portion as described above. Alternatively, an independent liquid intake into the fluidic system can be carried out via passive filling, i.e. by means of capillary forces of the channel system 3 at the fluidic interface 5. The suction effect caused by the negative pressure or the capillary forces, and thus the filling speed, can be increased or accelerated by a surface modification, for example hydrophilization of the channel surface of the channel system 3.

Furthermore, the volume of the received liquid can be determined by means of passive valves in channel system 3, for example capillary stop valves and channel tapers 41, see FIG. 7*a*, of channel system 3. A defined quantity of liquid is thus taken in, wherein a sealing cap prevents the liquid from escaping when the liquid reservoir 16 is emptied.

Figure 8A:
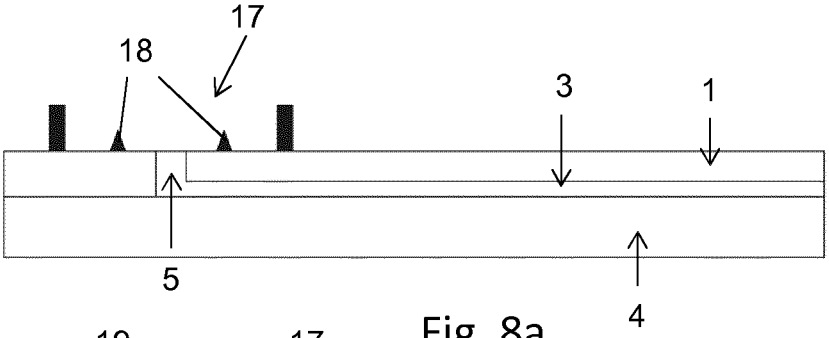
FIGS. 8*a* to 8*e* show an ejection mechanism of a fluidic system according to an embodiment.
Figure 8B:
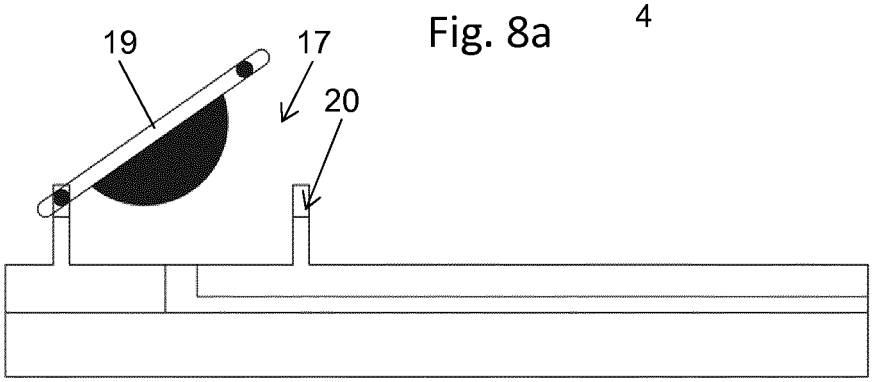
Figure 8C:
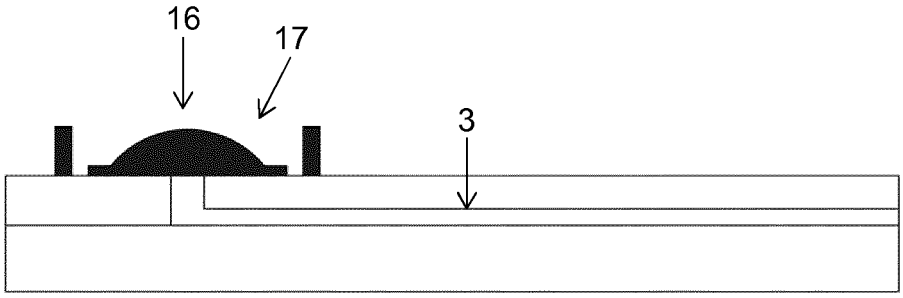
Figure 8D:
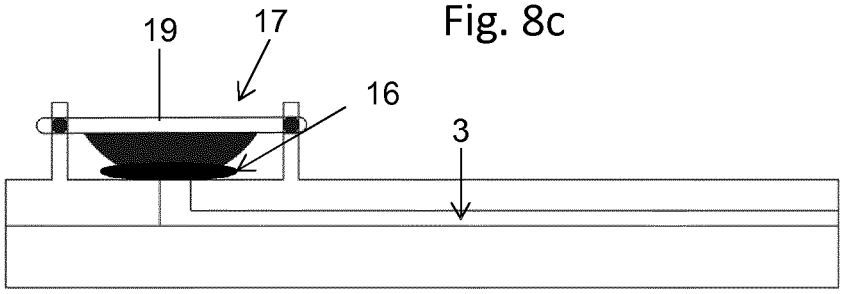

FIGS. 8*a* to 8*e* show an ejection mechanism for the liquid reservoir 16 according to an embodiment. For example, the ejection mechanism may be formed as a flap 19, wherein the latching of the flap 19, as shown in FIG. 8*d*, is the insertion of a defined amount of liquid from the liquid reservoir 16 into the channel system 3 of the fluidic system, thereby achieving a defined mixing ratio of the liquid from the liquid reservoir with the liquid received in the fluidic system. FIG. 8*d* shows a state in which the flap 19 presses the liquid reservoir 16 onto the fluidic interface 5 of the channel of the channel system 3. This principle can be extended to further liquid reservoirs 16 and can therefore be used for multiple mixtures.

FIG. 8*a* shows an ejection mechanism with a seat 17, which can be configured as a blister seat and has piercing elements 18, for example small tips.

FIG. 8*b* shows an embodiment of an ejection mechanism, wherein the seat 17 has latching lugs 20 and the flap 19 is mounted in a hinge-like manner on the latching lugs 20 of the seat 17. As shown in FIG. 8*b*, the liquid reservoir 16 is arranged at the flap 19. The ejection mechanism shown in FIG. 8*b* may also have a piercing 18 (not shown). One of the latching lugs 20 serves as hinge and another one of the latching lugs 20 serves as latching surface or seating surface for the flap 19 in order to limit a rotation of the flap 19. This means that when the flap 19 is closed, the liquid reservoir 16 is pierced and the liquid from the liquid reservoir can be introduced into the channel system 3 of the fluidic interface. By limiting the rotation of the flap 19 by the latching lugs 20, a defined or predetermined amount of liquid can be discharged from the liquid reservoir to the fluidic system.

The seat 17 can also be referred to as reservoir interface.

FIG. 8*c* shows an embodiment of the ejection mechanism in which the liquid reservoir 16 is located on the surface of the structured component 1. In this case, the flap 19 may have a bulge or projection as shown in FIG. 8*d*, so that the liquid reservoir 16 is squeezed by the projection when the flap 19 is closed. FIG. 8*d* shows the closed ejection mechanism, in this case the flap 19.

Figure 8E:
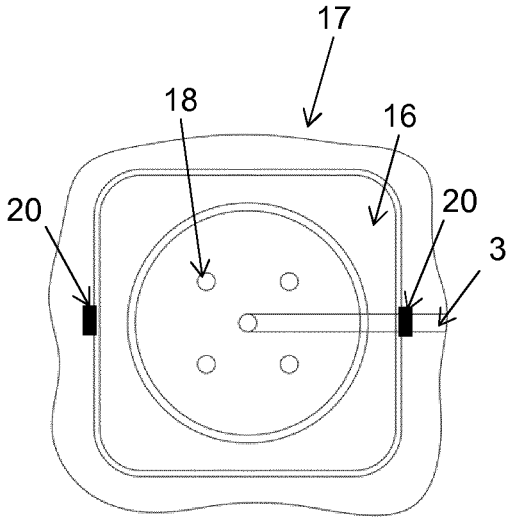

FIG. 8*e* is a top view of an ejection mechanism with seat 17 according to an embodiment.

Figure 9A:
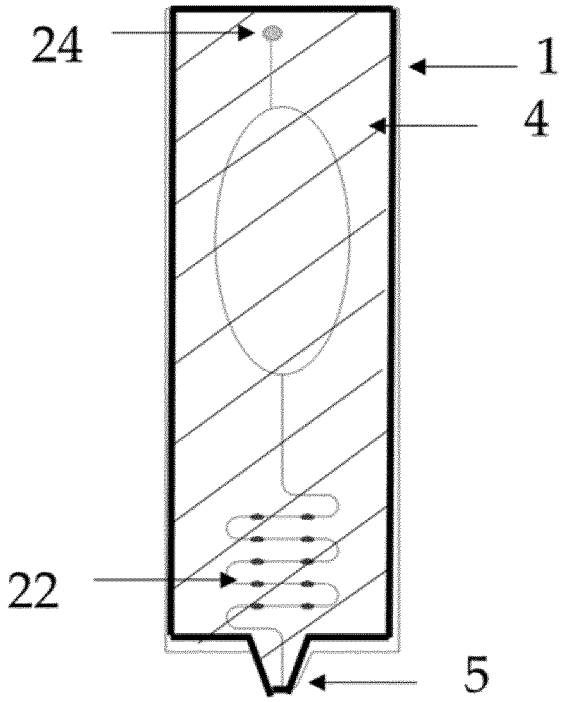
FIGS. 9*a* and 9*b* show a fluidic system having widenings and a detection chamber according to embodiments.
Figure 9B:
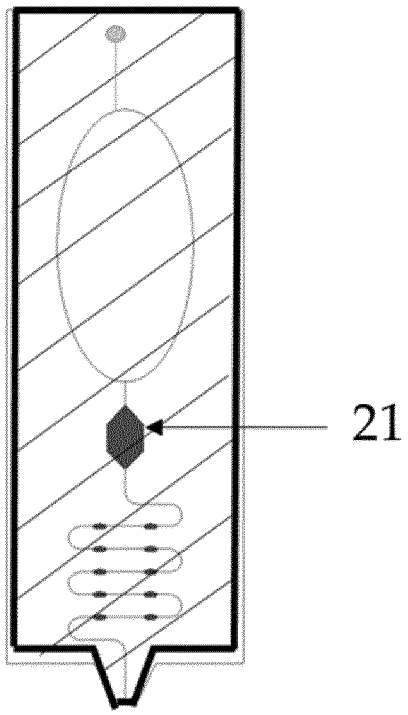

FIGS. 9*a* and 9*b* show a fluidic system with a long channel system 3. As shown in FIGS. 9*a* and 9*b*, the channel system 3 meanders between the fluidic interface 5 and the chamber 2, increasing the length of the channel system 3. This creates a dwell distance for the liquid received in the fluidic system. The dwell distance can be filled with reagents such as dried reagents. This allows a long channel system 3 to be formed. The channel system 3 can also have widenings 22 for better mixing, as shown in FIG. 9*a*, or another passive mixing element. As shown, the widenings can be formed elongated or in the direction of flow in the channel system 3. Liquid or reagents can be introduced into the widenings 22 which is/are mixed with liquid taken into the channel system 3 or the fluidic system or discharged from the fluidic system. The channel system 3 may also have an optical detection chamber or reaction chamber 22, 21 as shown in FIG. 9*b*. A particular advantage is the configuration of the detection chamber 21 in different depths in order to extend the dynamic range of the measurement. In other words, the detection chamber 21 can be embedded to different depths in the structured component 1, so that, for example, it has step-like detection chamber bottoms of different depths.

Figure 10A:
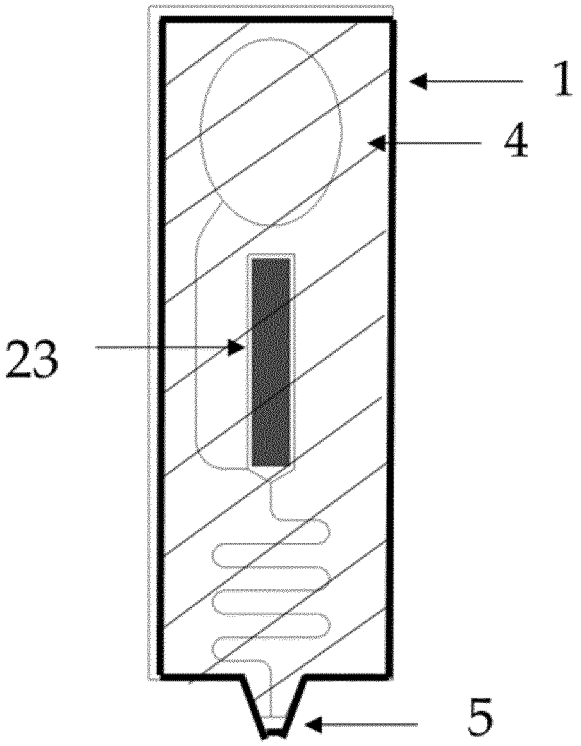
FIGS. 10*a* to 10*c* show a fluidic system having a lateral flow strip according to embodiments.
Figure 10B:
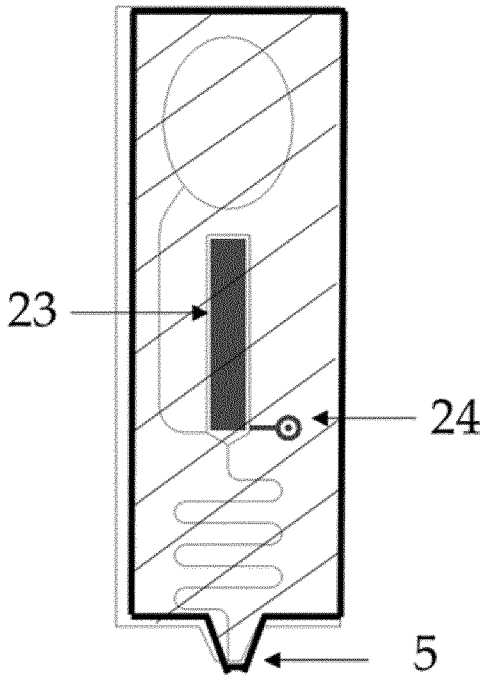
Figure 10C:
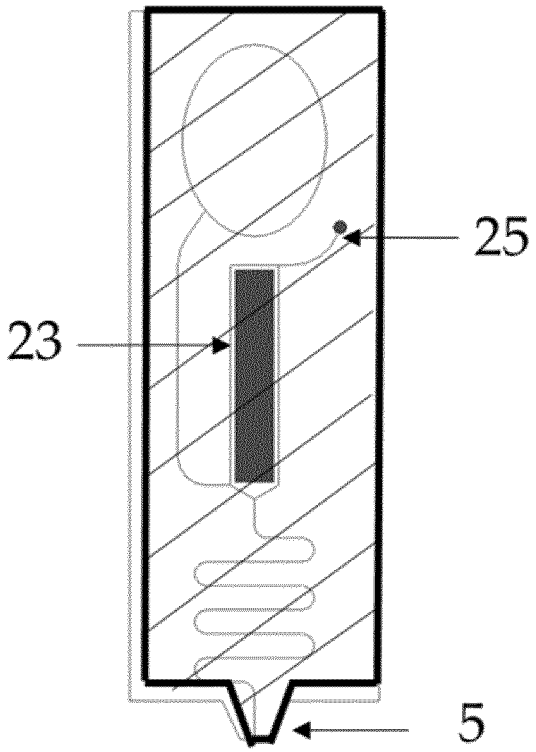

A further option for extending the chamber functionality is the insertion of a lateral flow strip 23, as shown in FIGS. 10*a* to 10*c*, which can be filled in a defined manner using the pump function of the fluidic system. Thus, a combination of filling by the pumping action of the chamber 2 in manual operation as described above or by means of an operating device and the suction action of the lateral flow strip can also be carried out. As shown in FIGS. 10*a* to 10*c*, the lateral flow strip is inserted into another chamber, which is also connected to the channel system 3. The use of ventilation channels 25 or gas-permeable and fluid-tight membranes 24, each connected to the channel system 3 or the chamber of the lateral flow strip, to operate the system is particularly advantageous. This is shown, for example, for the gas-permeable and fluid-tight membranes 24 in FIG. 10*b* and for the ventilation channels 25 in FIG. 10*c*.

Figure 11:
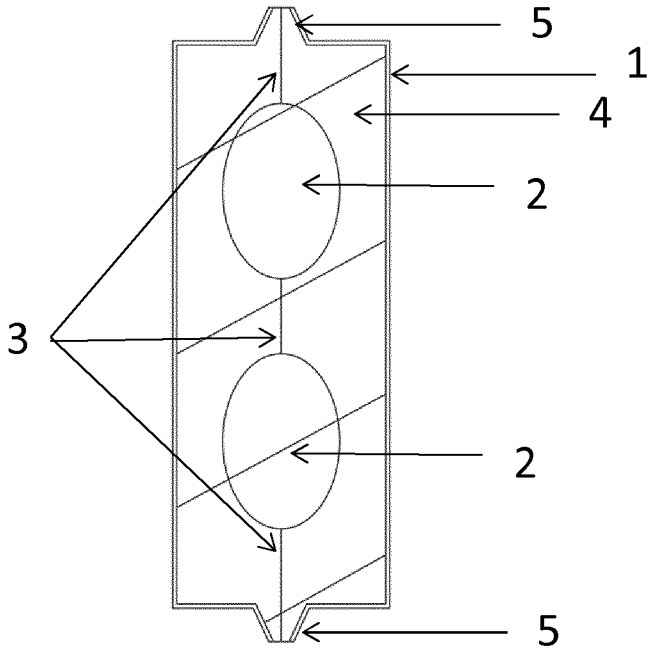
FIG. 11 shows a fluidic system according to another embodiment.

FIG. 11 shows a fluidic system according to a yet further embodiment. As shown in FIG. 11, the structured component 1 has two chambers 2 which are embedded in the upper side of the structured component. The two chambers 2 are directly connected to each other via a first channel system 3 or a channel. The two chambers 2 are also each connected to the outside via a respective fluidic interface 5 and via a respective second channel system 3 or a channel. This embodiment of the fluidic system can also be referred to as a combined chamber system. The use of combined chamber systems, which can then be used simultaneously as mixing, reaction, pump and/or dosing units, is a further embodiment of the fluidic system.

FIGS. 12*a* to 12*d* show embodiments of the fluidic system with distribution systems 26. As shown in FIGS. 12*a* to 12*d*, a chamber 2 is connected at one end to a distribution system 26. Distribution system 26 can be part of the channel system 3. The distribution system 26 has one or more channels leading away from the chamber 2 and branching from each other. The ends of the respective branched channels of the distribution system 26 are each connected to a fluidic interface 5. As shown in the embodiments of the fluidic system of FIGS. 12*a* to 12*d*, a respective channel leads away from the chamber 2 and branches to four channels, each of which is connected to a respective fluidic interface. By moving the flexible portion 6, 7, 9 and the associated change of the chamber volume, the distribution systems allow a simultaneous or successive liquid intake or liquid discharge.

Figure 12A:
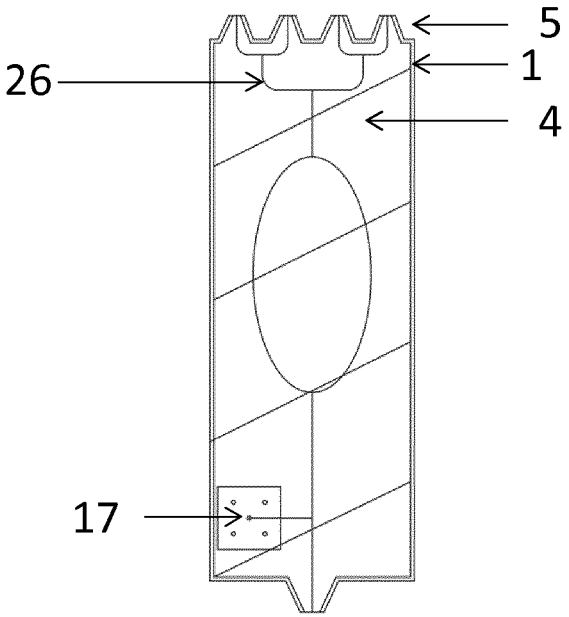
FIGS. 12*a* to 12*d* show a fluidic system having a distribution system according to an embodiment.
Figure 12B:
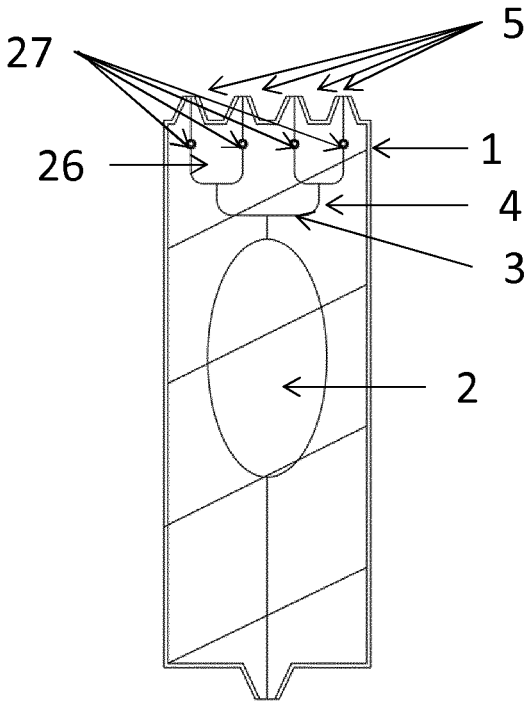

FIGS. 12*a* and 12*b* show a fluidic system including a distribution system 26, wherein the channel leading away from the chamber 2 branches step by step, namely first into two further channels. The two further channels then branch into two further channels, so that the channel leading away from the chamber 2 branches into a total of four channels, which lead into the respective fluidic interfaces 5. In FIG. 12*a* all fluidic interfaces 5 are simultaneously controlled by a movement of the flexible portion 6, 7, 9. As shown in FIG. 12*b*, the branched channels of the distribution system 26 can have membrane valves 27. The use of membrane valves 27 requires the membrane valves 27 to be pressed in and the membrane valves 27 to be sealed fluid-tight in order to close the respective channels individually or together and thus to be able to implement the liquid intake or liquid discharge via the fluidic interfaces 5. In other words, the membrane valves 27 can be used to control the flow of liquid within the respective channels in a targeted and defined manner. This means that the individual fluidic interfaces 5 can be systematically controlled or activated by means of the membrane valves 27. This means that they can be controlled independently of each other. The membrane valves 27 can be brought into a state which does not permit any liquid flow in the respective channel, a state which permits an unhindered liquid flow in the respective channel, and/or a state which permits a reduced liquid flow in the respective channel, or can be activated accordingly. Thus, a defined and/or simultaneous liquid intake or liquid discharge can be systematically controlled via the respective fluidic interfaces 5.

Figure 12C:
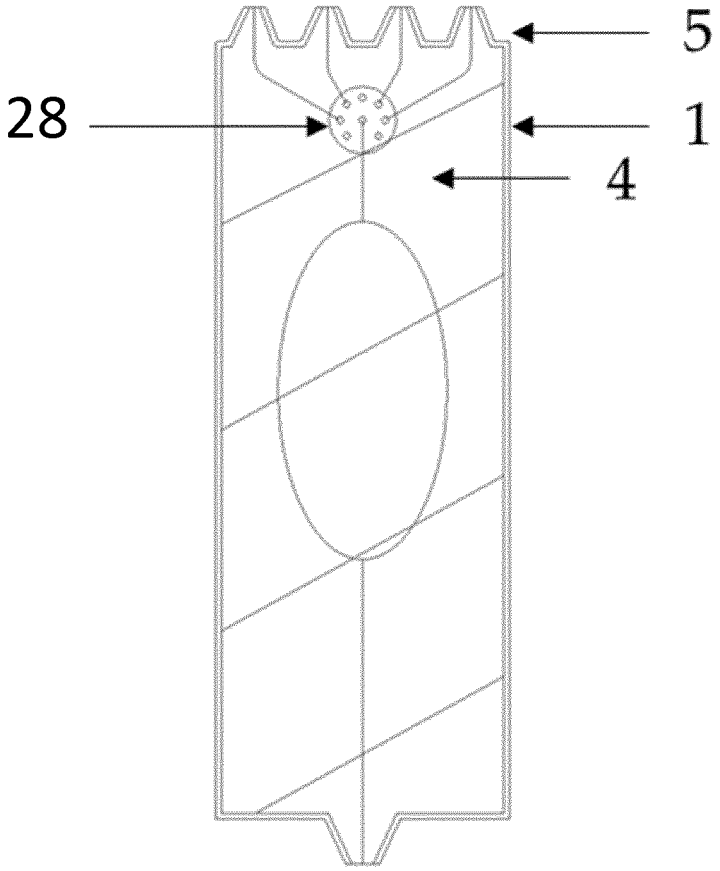
Figure 12D:
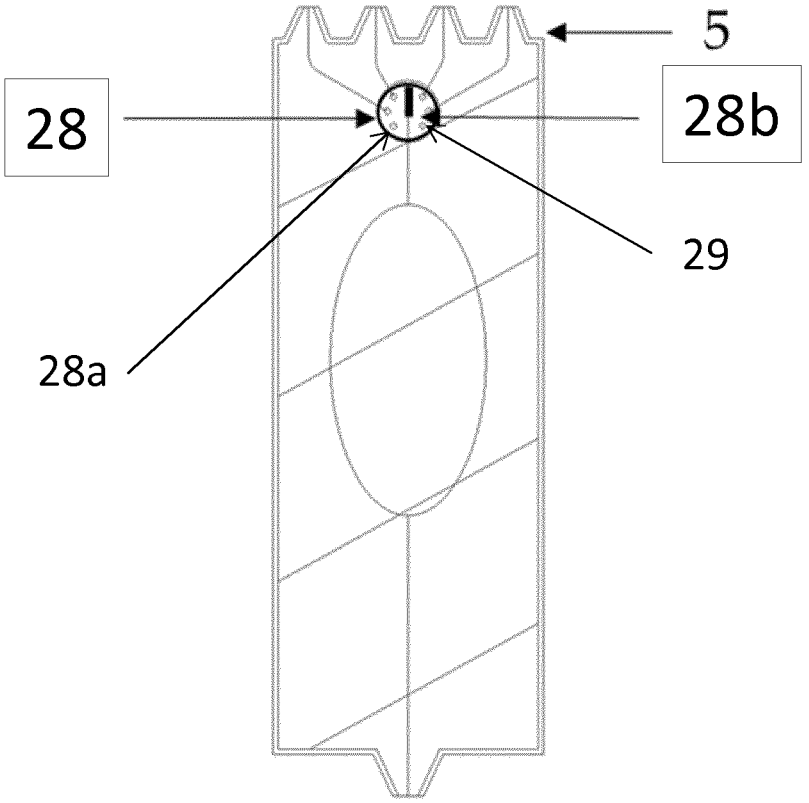

FIGS. 12*c* and 12*d* show an embodiment of the fluidic system including a distribution system 26, in which the channel leading away from the chamber 2 branches at one point in a star shape into four further channels. As shown in FIG. 12*c*, a rotary valve 28 can be arranged at the branching point, which can be operated from the outside either manually or by means of a device. With the help of the rotary valve 28, a defined liquid flow can thus be connected between the channel leading away from the chamber 2 and one or more channels connected to the branched channels, i.e. to the fluidic interfaces 5. The body of the rotary valve 28 may itself have one or more embedded channels 29 which, when positioned at the point of branching which may form the seat 28*a* of the rotary valve 28, connect the branched or connected channels. Depending on the configuration of a distribution channel 29 integrated in the rotary valve body 28*b*, the option with a rotary valve 28 permits sequential or parallel liquid intake or liquid discharge via one or more fluidic interfaces 5, which in turn is controlled by changing the chamber volume. It is also possible to combine one or more membrane valves 27 and/or rotary valves 28 in one fluidic system. This means that the individual fluidic interfaces 5 can also be systematically controlled by means of the rotary valves 28. This means that they can be controlled independently from one another.

In general, the following applies to the fluidic system according to the present invention: all processes described for the use of liquids are equivalent to gases and a combination of liquid and gaseous substances is also possible with this fluidic system, for example the systematic supply of gases to liquids.

Figure 13:
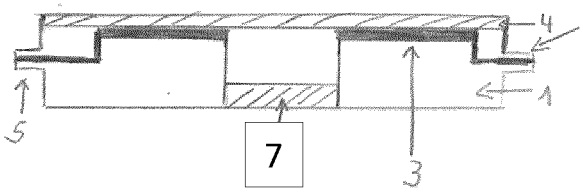
FIG. 13 shows a fluidic system according to another embodiment.

A further embodiment form is shown in FIG. 13. Here, the structured component 1 has a flexible portion 7 below the chamber 2, which is realized either by the application of another component into the structured component 1 or directly by the material property of the structured component 1 itself or by the manufacturing from more than one material, for example by multi-component injection molding.

Figure 14A:
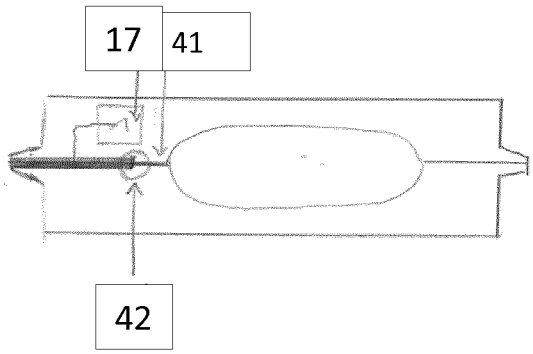
FIG. 14*a*, 14*b* shows a fluidic system having a magnification device according to an embodiment.
Figure 14B:
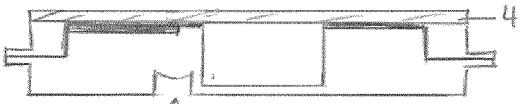

A further embodiment is shown in FIGS. 14*a* and 14*b* as a plan view and as a section view, respectively, wherein at a defined position above or below the chamber 2 or the channel system 3 a magnification function 42 is provided in the structured component 1, which is configured for example in the form of a lens in order to be able to better follow the reaching of certain positions in the channel system 3 by the liquid and also to be able to better read colour reactions as indicator reactions.

Figure 15A:
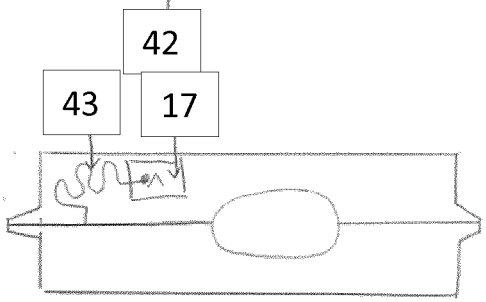
FIGS. 15*a* to 15*c* show a fluidic system having flow limiters according to embodiments.
Figure 15B:
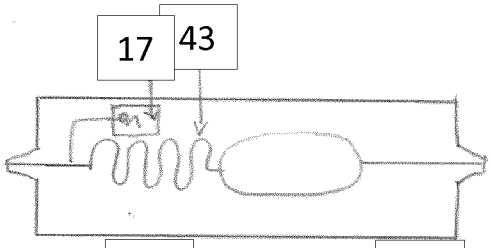
Figure 15C:
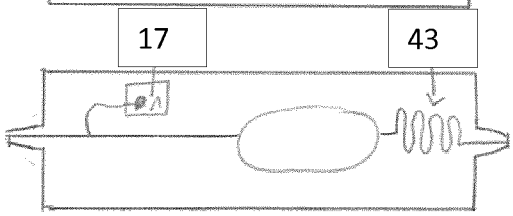

A further embodiment is shown in FIGS. 15*a* to 15*c*, wherein longer channel elements are provided in the liquid flow in the channel system 3 as flow limiters 43, in order to enable controlled liquid intake and discharge. The flow limiters 43 are formed in a meander shape and/or are configured as channel tapering to control the flow of a liquid and/or limit the velocity.

As shown in FIGS. 6*a* to 7*b* and FIGS. 9*a* and 15*c*, according to all of these embodiments the chamber 2 can be connected to several channels or the channel systems 3, each of which leads to at least one fluidic interface 5. The fluidic system can therefore have a plurality of fluidic interfaces 5 and the chamber 2 can have several outgoing channels or channel systems 3.

Figure 16:
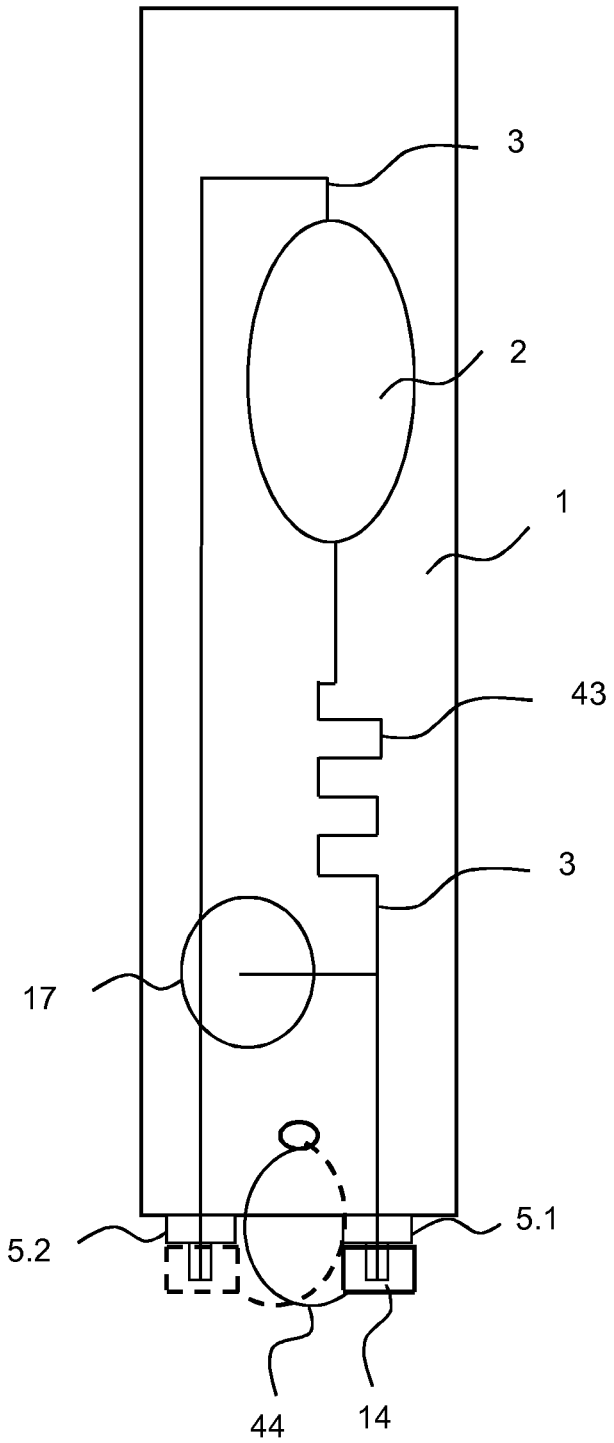
FIG. 16 shows an embodiment of the chip having a cap in a plan view from above.

FIG. 16 shows an embodiment of the chip in a view from above. It shows the structured component 1 with a chamber 2 and the channel system 3. The channel system 3 connects the inlet 5.1. with the chamber 2 and connects the chamber with the outlet 5.2.

The channel system 3 incorporates a flow limiter 43, which is formed in a meander shape and/or can contain channel tapers, with which the flow velocity of the liquid can be controlled or reduced. A reservoir interface 17 having a liquid reservoir 16 is connected to the channel system 3.

The inlet and the outlet can be closed with a cap 14, which is attached to the chip by a flap 44. Preferably, only one cap 14 is provided, which can be fitted alternately on the inlet or the outlet to selectively enable the chip to receive liquids when the inlet is open, i.e. without the cap 14, and the outlet 5.2 is closed with a cap 14. Thus, a required negative pressure can be built up to take in a liquid via the fluidic interface 5.1 (inlet). After the intake and corresponding analysis in the chip, the liquid should be discharged again. To this end, the cap 14 is placed on the inlet and the inlet is sealed fluid-tight. The liquid can then be discharged via the outlet 5.2. Thus, the cap 14 can be used to switch between two functions of the chip.

In a further configuration, it is possible to attach several caps 14 to the chip, for example to allow the chip to be transported or stored, wherein either the inside of the chip is protected from contamination and/or leakage of liquids present inside is prevented.

The following is a list of examples:

1. A fluidic system comprising a structured component (1) having a chamber (2) and a channel system (3),
   wherein at least the chamber (2) is closed in a fluid-tight manner by a component (4) and is fluidically connected to the outside via the channel system (3) and a fluidic interface (5),
   wherein the component (4) has a flexible or movable portion (6) which can be moved at least into a portion of the chamber (2) or beyond a plane of the chamber (2), wherein by a movement of the flexible or movable portion (6) liquids or gases can be taken in or discharged through the fluidic interface (5) or moved in the fluidic system, and
   wherein the flexible or movable portion (6) is movable by hand or with an operating device, and a pushing or an elevating of the flexible or movable portion (6) is possible.
2. A fluidic system comprising:
   a structured component (1) having a chamber (2) and a channel system (3),
   wherein the chamber (2) and the channel system (3) are closed in a fluid-tight manner by a component (4),
   wherein the chamber (2) is fluidically connected to the outside via the channel system (3) and the fluidic interface (5), and
   wherein the structured component (1) has a flexible or movable portion (6) forming side walls of said chamber (2).
3. A fluidic system comprising:
   a structured component (1) having a chamber (2) and a channel system (3),
   a component (4) which closes the chamber (2) and the channel system (3) in a fluid-tight manner,
   wherein the chamber (2) is connected to the outside via the channel system (3) and a fluidic interface (5), and
   wherein the structured component (1) is configured such that a bottom of the chamber (7) is flexibly configured and pressable.
4. A fluidic system according to one of the examples 1 to 3, wherein the chamber (2) is connected via a further channel system (3) to a further fluidic interface (5) and at least one of the fluidic interfaces (5) can be closed with a cap (14).
5. A fluidic system according to one of the examples 1 to 4, further including a venting device for the chamber (2), wherein the venting device is arranged such that venting can take place via an additional channel (25) connected to the outside or a gas-permeable membrane (24).
6. A fluidic system according to one of the examples 1 to 5, further including an inlet channel which has a passive stopping function and is filled either by capillary action or by a change in the chamber volume caused by the flexible or movable components and takes in a defined quantity of liquid.
7. A fluidic system according to one of the examples 1 to 6, further including an additional regent reservoir (16).

8. A fluidic system according to example 7, wherein the additional reagent reservoir (16) is configured as a blister (16), wherein the reagent reservoir (16) comprises:
   a blister seat (17) having piercing elements (18) adapted to pierce the blister (16) fluid-tightly connected above the piercing elements (18),
   a flap (19), which is pushable in a defined manner using guide elements (20) in the blister seat (17), whereby a defined volume dosage is possible.
9. A fluidic system according to one of the examples 1 to 8, wherein a channel (3) leading to the chamber (2) has widenings (22).
10. A fluidic system according to one of the examples 1 to 9, which has a cavity (21) for optical readout and/or reaction, and which preferably has different depths.
11. A fluidic system according to one of the examples 1 to 10, including a lateral flow strip (23), the filling of which is made possible by an operation of the chamber, wherein a venting membrane (24) and/or a venting channel (25) is coupled to the lateral flow strip (23).
12. A fluidic system according to one of the examples 1-11, having at least two chambers (2), wherein the at least two chambers 2 are directly connected to one another via a channel system 3.
13. A fluidic system according to one of the examples 1 to 12, including attachments (11, 12, 13) on the flexible or movable component (6), which are either located outside the chamber (2) or extend into the chamber (2).
14. A fluidic system according to one of the examples 1-13, wherein chamber 2 has reagents therein.
15. A fluidic system according to one of the examples 1 to 14, further comprising movable elements introduced into the chamber (2) for mixing.
16. A fluidic system according to one of the examples 1-15, wherein mixing of liquids takes place within the chamber 2 by a manual movement of the fluidic system and/or by a mixing device.
17. A fluidic system according to one of the examples 1 to 16, wherein the channel system (3) has alignment marks, or alignment marks are attached next to, below or above the channel system (3), which enable a volume indication.
18. A fluidic system according to one of the examples 1 to 17, with which a multiple liquid intake or liquids discharge takes place.
19. A fluidic system according to one of the examples 1 to 18, having fluidic interfaces (5) which point in different directions, are arranged on different sides of the fluidic system or leave the fluidic system at a predetermined angle.
20. A fluidic system according to one of the examples 1 to 19, wherein an intake or discharge of liquids is controllable using rotary valves (28).
21. A fluidic system according to one of the examples 1 to 20, wherein the intake or discharge of liquids is controllable using membrane valves (27).
22. A fluidic system according to one of the examples 6 to 21, where the passive stopping function is configured as a capillary stopping valve, a channel tapering or a surface modification.
23. A fluidic system according to one of the examples 7 to 22, wherein the reagent reservoir (16) is configured as a blister.
24. A fluidic system according to one of the examples 8 to 23, wherein the guide elements (20) enable multi-stage volume dosing.
25. A fluidic system according to one of the examples 8 to 24, wherein a fluid-tight closure of the fluidic interface (5) for the liquid intake is configured as a cap (14).
26. A fluidic system according to one of examples 4 to 25, wherein the cap (14) has a flexible portion configured to be pushed in or pulled out after being put on, thereby moving the liquid in the channel system (3).
27. A fluidic system according to one of the examples 5 to 26, wherein the venting device is closable.
28. A fluidic system according to one of the examples 12 to 27, wherein the at least two chambers (2) are arranged in one or more planes.
29. A fluidic system according to one of the examples 15 to 28, wherein the movable elements are configured as balls or rods.
30. A fluidic system according to one of the examples 15 to 29, wherein structural elements are formed in the structured component (1) to enhance mixing.
31. A fluidic system according to one of examples 1 to 30, the fluidic interface (5) further comprising an outlet (10), wherein by means of a geometry of the outlet (10) the volume of a discharged drop of liquid is preset.
32. A fluidic system according to one of the examples 1 to 31, further comprising a cap (14), wherein the cap (14) is placed fluid-tightly on the fluidic interface (5).
33. A fluidic system according to one of the examples 1 to 32, further comprising a plurality of fluidic interfaces (5) which are connected to a distribution system (26), wherein the plurality of fluidic interfaces (5) can be selectively controlled.
34. A fluidic system according to one of the examples 1 to 33, wherein an independent liquid intake into the fluidic system is carried out by means of capillary forces of the channel system (3) at the fluidic interface (5).

List of reference numerals:

| | |
|---|---|
| 1 | structured module/structured component |
| 2 | chamber |
| 3 | channel system/channel |
| 4 | component |
| 5 | fluidic interface |
| 5.1 | inlet |
| 5.2 | outlet |
| 6 | flexible or movable portion (on component 4) |
| 7 | flexible or movable portion (on structured component 1) |
| 8 | second component |
| 9 | flexible or movable portion (on second component 8) |
| 10 | outlet (of the fluidic interface 5) |
| 11, 12, 13 | pushing elements, geometric elements, attachments |
| 14 | cap |
| 16 | liquid reservoir |
| 17 | seat/reservoir Interface |
| 18 | piercing elements |
| 19 | flap |
| 20 | latching lugs |
| 21 | detection chamber |
| 22 | widening |
| 24 | membrane |
| 25 | ventilation channels |
| 26 | distribution system |
| 27 | membrane valve |
| 28 | rotary valve |
| 28a | rotary valve seat |
| 28b | rotary valve body |
| 29 | distribution channel |
| 41 | capillary stop valves/channel tapers |
| 42 | magnifying device |
| 43 | flow limiter |
| 44 | flap |

The invention claimed is:

1. A microfluidic system, comprising:

a planar structured component being essentially flat or plate-like having one longitudinal extension and a shorter lateral extension, and an other planar component being essentially flat or plate-like, the planar structured component having a chamber and a channel system, wherein the chamber and the channel system are formed as recesses into the planar structured component from a same planar surface, so that the channel system and the chamber are open at said same planar surface, wherein the channel extends in longitudinal direction of the planar structured component and is connected to the chamber, the other planar component being attached to the planar surface of the planar structured component, so that the chamber and the channel system are formed by the planar structured component and the other planar component, so that the chamber and the channel system are liquid-tight closed at the surface of the planar structured component, wherein the chamber is fluidically connected to the outside via the channel system and at least one fluidic interface, wherein the fluidic interface is formed at a lateral side surface of the planar structured component and protrudes as a projection from the lateral side surface of the planar structured component, wherein the other planar component being attached to the planar surface of the planar structured component has a flexible and movable portion at least partially adjacent to the chamber, wherein the flexible and movable portion is adapted to be pushed by a pressure applied by a thumb from outside due to its flexibility into the chamber in a direction perpendicular to the chamber and channel system, so that liquids or gases can be taken in or discharged via the at least one fluidic interface or moved in the microfluidic system, wherein the flexible and movable portion automatically moves back due to its material properties after being pushed into the chamber by actuation of the thumb.

2. The microfluidic system according to claim 1, wherein the flexible and movable portion is formed at least one side wall of the chamber within the structured component.

3. The microfluidic system according to claim 1, wherein the chamber is connected via a further channel system to a further fluidic interface and at least one of the fluidic interfaces is closable with a cap.

4. The microfluidic system according to claim 1, further comprising a venting device for the chamber, wherein the venting device is arranged such that venting can take place via a further channel connected to the outside or a gas-permeable membrane.

5. The microfluidic system according to claim 1, further comprising an inlet channel which has a passive stopping function and is filled either by capillary action or by a change in the chamber volume caused by the flexible and movable portion and receives a defined quantity of liquid.

6. The microfluidic system according to claim 1, further comprising an additional reagent reservoir.

7. The microfluidic system according to claim 6, wherein the additional reagent reservoir is configured as a blister, the additional reagent reservoir comprising:

a blister seat having piercing elements configured to pierce the blister fluid-tightly connected above the piercing elements, a flap, which is pushable in a defined manner using guide elements in the blister seat, whereby a defined volume dosage is possible.

8. The microfluidic system according to claim 1, wherein a channel leading to the chamber has widenings.

9. The microfluidic system according to claim 1, which has a cavity for optical readout and/or reaction, and which preferably has different depths.

10. The microfluidic system according to claim 1, comprising a lateral flow strip, the filling of which is enabled by an operation of the chamber, wherein a venting membrane and/or a venting channel is coupled with the lateral flow strip.

11. The microfluidic system according to claim 1, having at least two chambers, the at least two chambers being directly connected to one another via a channel system.

12. The microfluidic system according to claim 1, further comprising attachments on the flexible and movable portion, which are located outside the chamber or extend into the chamber.

13. The microfluidic system according to claim 1, said chamber having reagents therein.

14. The microfluidic system according to claim 1, further comprising movable elements inserted in the chamber for mixing.

15. The microfluidic system according to claim 1, wherein a mixing of liquids within the chamber is achieved by a manual movement of the microfluidic system and/or by a mixing device.

16. The microfluidic system according to claim 1, wherein the channel system has alignment marks, or is provided with alignment marks next to, below or above the channel system, allowing volume indication.

17. The microfluidic system according to claim 1, configured for multiple liquid intake or multiple liquid discharge.

18. The microfluidic system according to claim 1, having fluidic interfaces pointing in different directions or leaving the microfluidic system at a predetermined angle.

19. The microfluidic system according to claim 1, wherein an intake or discharge of liquids is controllable via rotary valves.

20. The microfluidic system according to claim 1, wherein the intake or discharge of liquids is controllable via membrane valves.

21. The microfluidic system according to claim 5, wherein the passive stopping function is provided in the form of a capillary stop valve, a channel taper or a surface modification.

22. The microfluidic system according to claim 6, wherein the additional reagent reservoir is formed as a blister.

23. The microfluidic system according to claim 7, wherein a configuration of the guide elements enables multi-stage volume dosing.

24. The microfluidic system according to claim 7, wherein a fluid-tight closure of the fluidic interface for the liquid intake is formed as a cap.

25. The microfluidic system according to claim 3, the cap having a flexible portion adapted to be pushed in or pulled out after attachment to thereby move the liquid in the channel system.

26. The microfluidic system according to claim 4, wherein the venting device is closable.

27. The microfluidic system according to claim 11, wherein the at least two chambers are arranged in one or more planes.

28. The microfluidic system according to claim 14, wherein the movable elements are formed as balls or rods.

29. The microfluidic system according to claim 14, wherein structural elements are formed in the structured component to enhance mixing.

30. The microfluidic system according to claim 1, the fluidic interface further comprising an outlet, wherein by means of a geometry of the outlet the volume of a discharged drop of liquid is preset.

31. The microfluidic system according to claim 1, further comprising a cap, the cap being fluid-tightly mounted on the fluidic interface.

32. The microfluidic system according to claim 1, wherein a fluidic interface is formed as an inlet of the microfluidic system and a fluidic interface is formed as an outlet of the microfluidic system, and the inlet and outlet are arranged on one side of the system, wherein a cap is fixed to the microfluidic system, preferably to the structured component, wherein the cap can be fitted either to the inlet or to the outlet, thus enabling a liquid to be received at the inlet or a liquid to be discharged at the outlet.

33. The microfluidic system according to claim 1, further comprising a plurality of fluidic interfaces which are connected to a distribution system, wherein the plurality of fluidic interfaces are selectively controllable.

34. The microfluidic system according to claim 1, wherein an independent liquid intake into the microfluidic system is enabled by means of capillary forces of the channel system at the fluidic interface.

35. The microfluidic system according to claim 1, further comprising a reservoir interface by means of which a liquid reservoir is connectable to the structured component.

36. The microfluidic system according to claim 35, wherein the reservoir interface is fluidically connected to the channel system and/or to the chamber.

37. The microfluidic system according to claim 1, wherein the channel system has valves, whereby the intake of defined liquid volumes is enabled.

38. The microfluidic system according to claim 37, wherein the valve function is generated or enhanced by surface functionalization.

39. The microfluidic system according to claim 1, wherein dry reagents are incorporated in the channel system of the structured component, wherein the dry reagents are absorbed into the flowing liquids and mixed therewith.

40. The microfluidic system according to claim 1, wherein a reagent is placed at a defined position in or at the channel system and colours liquid flowing over it so that a reaching of the position and thus a reaching of a certain volume or a defined dwell time is indicated.

41. The microfluidic system according to claim 1, wherein a magnifying device is arranged at least one defined position above or below the channel system or the chamber, so that a reaching of at least one specific position in the channel system can be detected by liquid and/or colour reactions.

42. The microfluidic system according to claim 41, wherein the magnifying device is configured as a lens.

43. The microfluidic system according to claim 1, wherein longer channel elements are incorporated as flow limiters into a fluid path of the channel system in order to enable a controlled liquid intake and liquid discharge.

44. The microfluidic system according to claim 7, wherein a defined ejection of defined volumes is achieved by means of the flap.

45. The microfluidic system according to claim 1, wherein a defined movement of the flexible and movable portion is achieved by means of geometric elements or attachments.

46. The microfluidic system according to claim 45, wherein a flap and the geometric elements or attachments configured as pushing elements are connected, combined or coupled to one another on the flexible and movable portion.

47. The microfluidic system according to claim 1, wherein a distribution system comprising a plurality of channels which open into a corresponding number of fluidic interfaces, enables a simultaneous intake and discharge of liquids.

48. The microfluidic system according to claim 47, wherein a uniform distribution of liquids in the distribution system is supported by integrated passive valves.

49. The microfluidic system according to claim 1, wherein valves enable a selective liquid discharge from individual fluidic interfaces.

50. The microfluidic system according to claim 1, wherein the liquid is taken in passively by the fluidic interface without a movement of the flexible and movable portion.

* * * * *